United States Patent [19]

Lemme et al.

[11] Patent Number: 4,579,504

[45] Date of Patent: Apr. 1, 1986

[54] CRANE FOR LIFTING DEVICE SUCH AS FORK LIFT

[76] Inventors: Daniel C. Lemme, 17441 Valley Blvd., Bloomington, Calif. 92316; Tracy R. Lemme, 5330 Nottingham Rd., Riverside, Calif. 92506; Charles D. Lemme, 820 N. Igo Way, Tucson, Ariz. 85710

[21] Appl. No.: 755,203

[22] Filed: Jul. 12, 1985

Related U.S. Application Data

[63] Continuation of Ser. No. 531,755, Sep. 12, 1983, abandoned.

[51] Int. Cl.[4] ..... B66F 9/06

[52] U.S. Cl. ..... 414/607; 414/912; 212/201

[58] Field of Search ..... 212/152, 153, 201; 414/607, 912; 294/82.11

[56] References Cited

U.S. PATENT DOCUMENTS

| | | | |
|---|---|---|---|
| 855,159 | 5/1907 | Brown | 294/82.11 |
| 2,433,584 | 12/1947 | Turner . | |
| 2,445,614 | 7/1948 | Flynn et al. . | |
| 2,494,651 | 1/1950 | Flynn . | |
| 2,517,085 | 8/1950 | Cirillo | 212/201 |
| 2,744,637 | 5/1956 | Stewart | 212/152 |
| 3,007,592 | 11/1961 | Adams | 414/607 |
| 3,207,347 | 9/1965 | Ehrlich . | |
| 3,294,262 | 12/1966 | Person . | |
| 3,391,906 | 7/1968 | Duerst | 212/152 |
| 3,396,862 | 8/1968 | Fischer | 414/607 |
| 3,587,893 | 6/1971 | Laken | 414/607 |
| 3,759,399 | 9/1973 | Glass et al. . | |
| 3,773,200 | 11/1973 | Morris . | |
| 3,788,492 | 1/1974 | Kraft . | |
| 3,924,752 | 12/1975 | Hoofnagle | 212/153 |

FOREIGN PATENT DOCUMENTS

| | | | |
|---|---|---|---|
| 1332802 | 10/1973 | United Kingdom | 414/607 |

*Primary Examiner*—Trygve M. Blix
*Assistant Examiner*—Thomas J. Brahan
*Attorney, Agent, or Firm*—Willian Brinks Olds Hofer Gilson & Lione Ltd.

[57] ABSTRACT

A crane is disclosed for use with a lifting device such as a fork lift. The crane includes a crane base which is adapted to be secured to the forks of the fork lift, and an inclined crane boom which is rigidly secured to the crane base. The upper end of the crane boom defines a guide such as a pulley, and a cable such as a chain is positioned over this guide. One end of the cable is fixedly mounted to the lower end of the mast of the fork lift, and the other end of the cable is secured to a lifting hook. This arrangement provides the important advantage that the separation between the hook and the pulley decreases as the crane is elevated by the fork lift. For this reason, the lifting height capacity of the crane is greater than the lifting height capacity of the fork lift, while the effective length of the cable remains constant. In this way, the cost and complexity of winches is avoided.

4 Claims, 8 Drawing Figures

FIG. 1
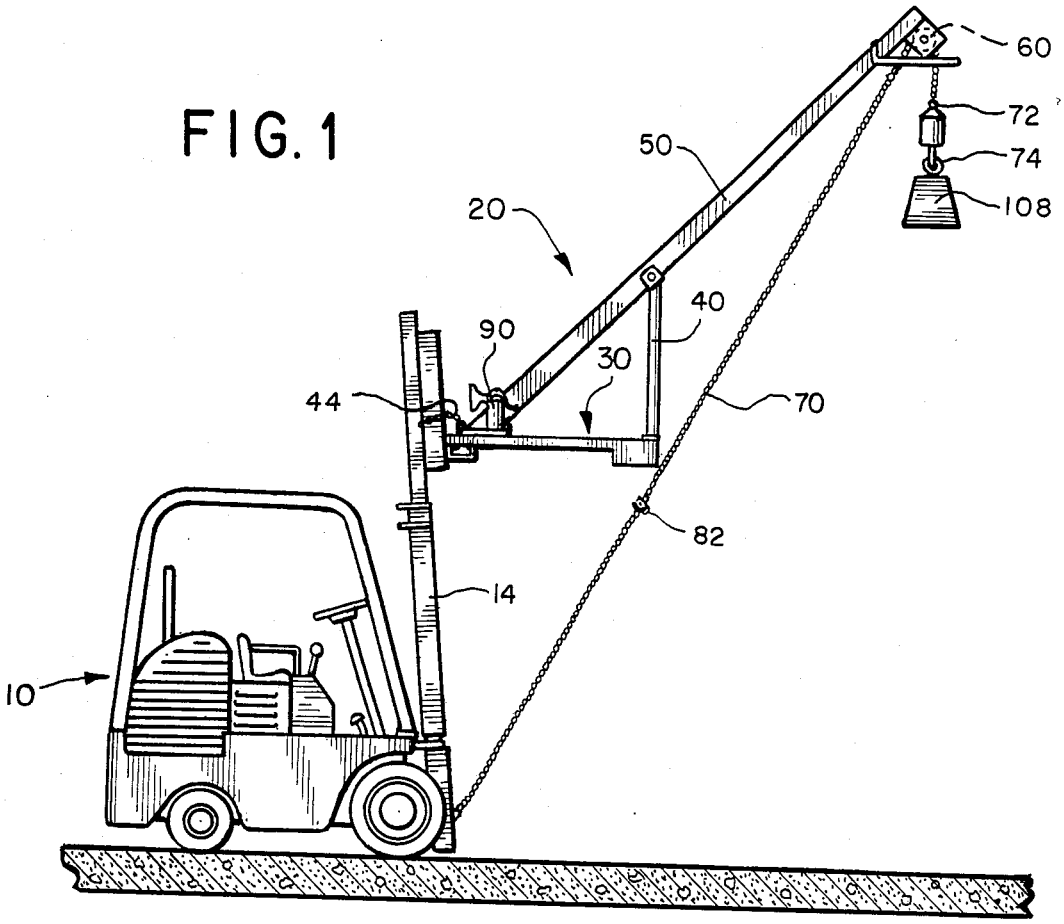
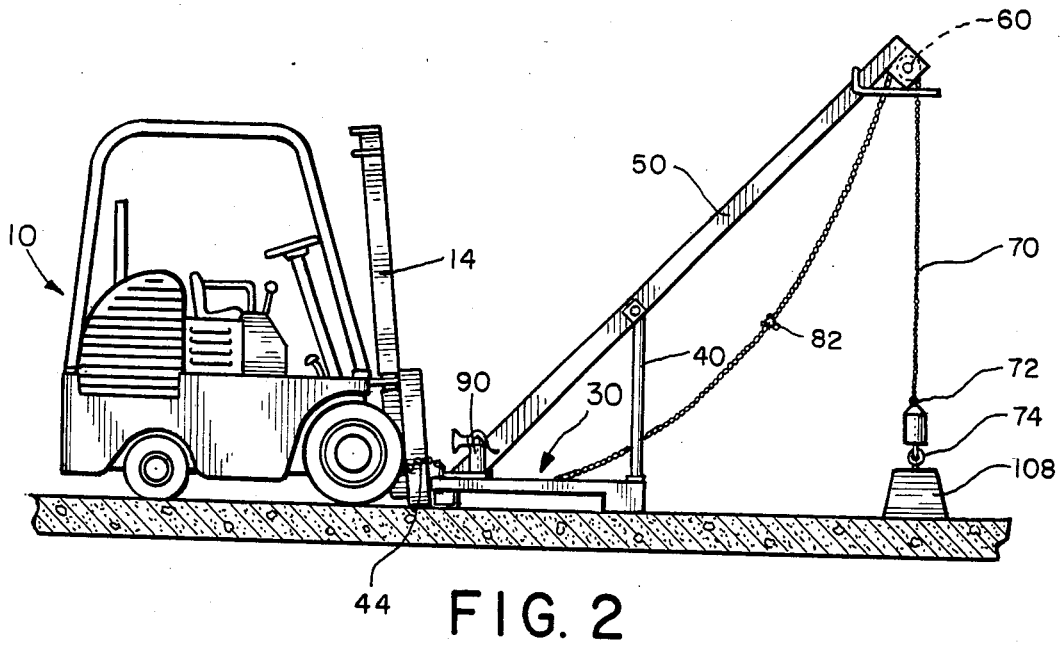
FIG. 2

FIG. 3
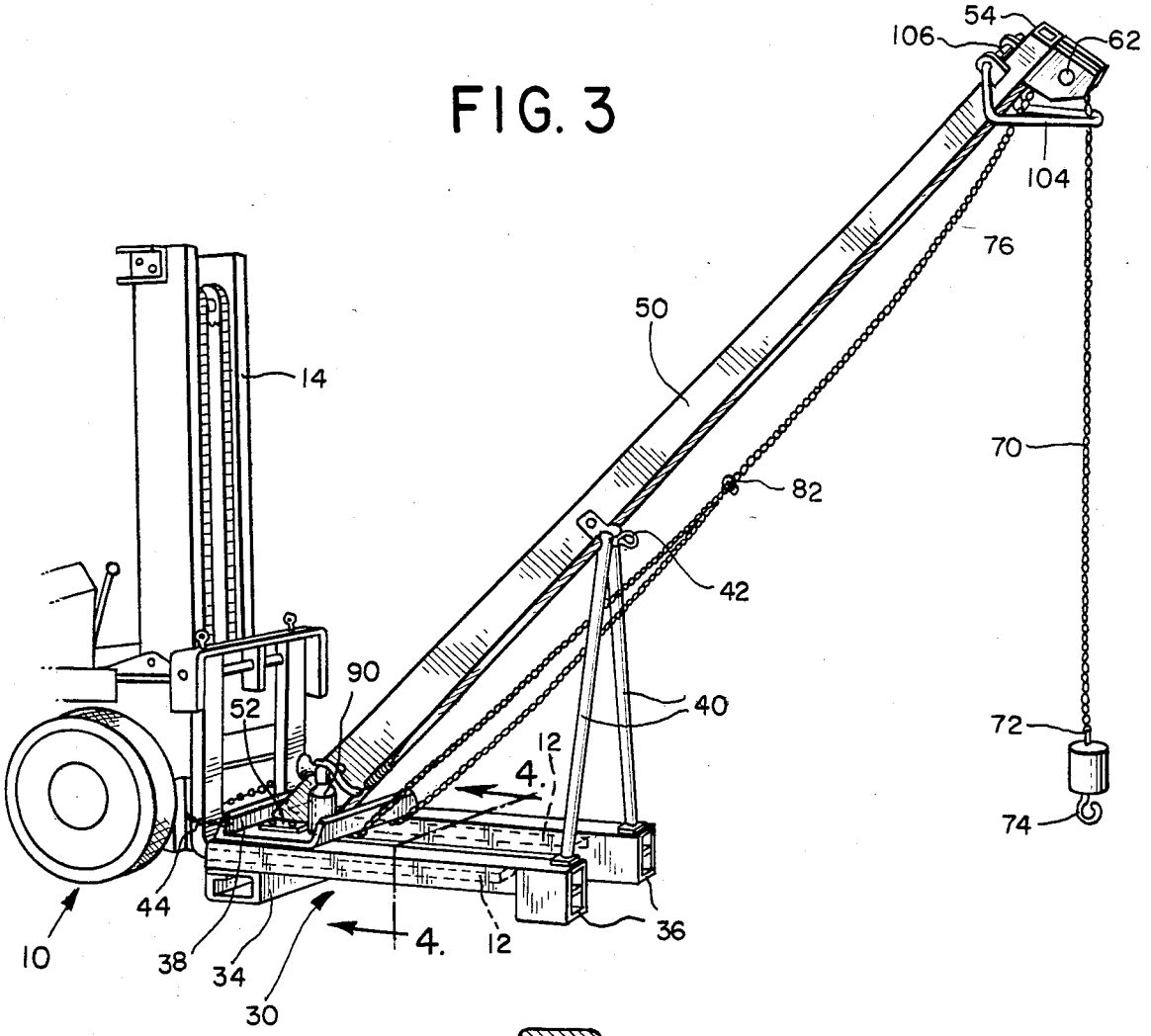
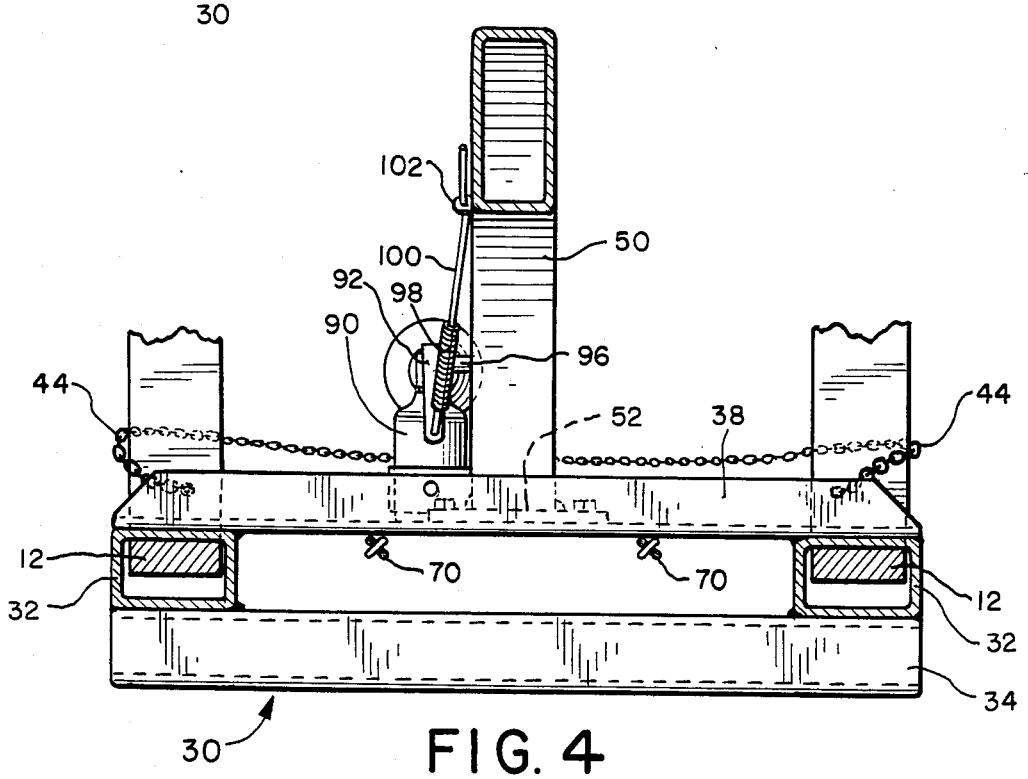
FIG. 4

FIG. 5a
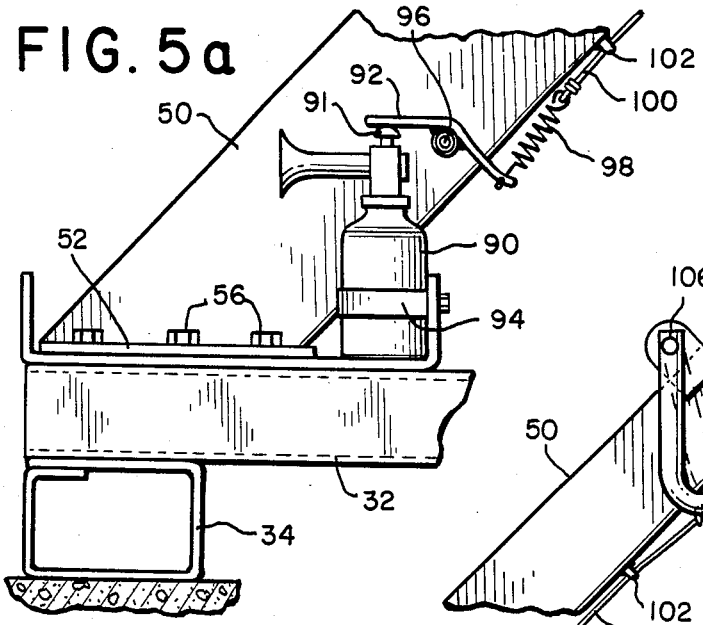
FIG. 5b
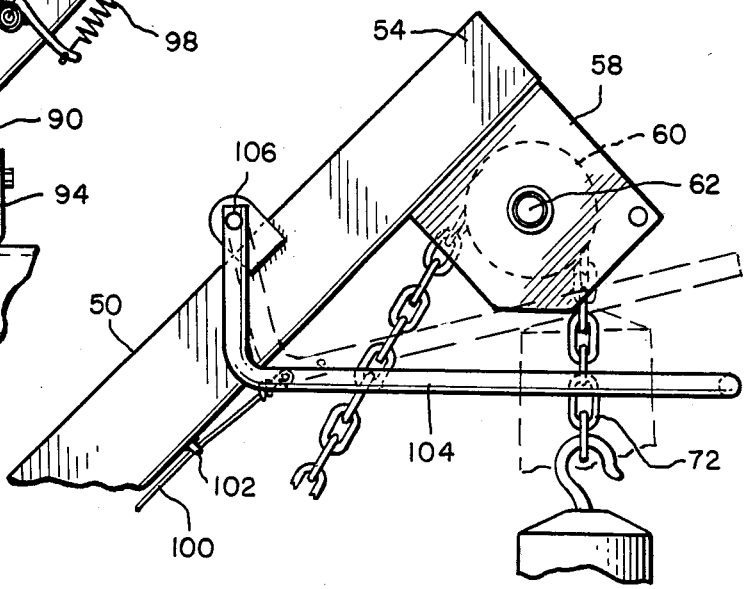
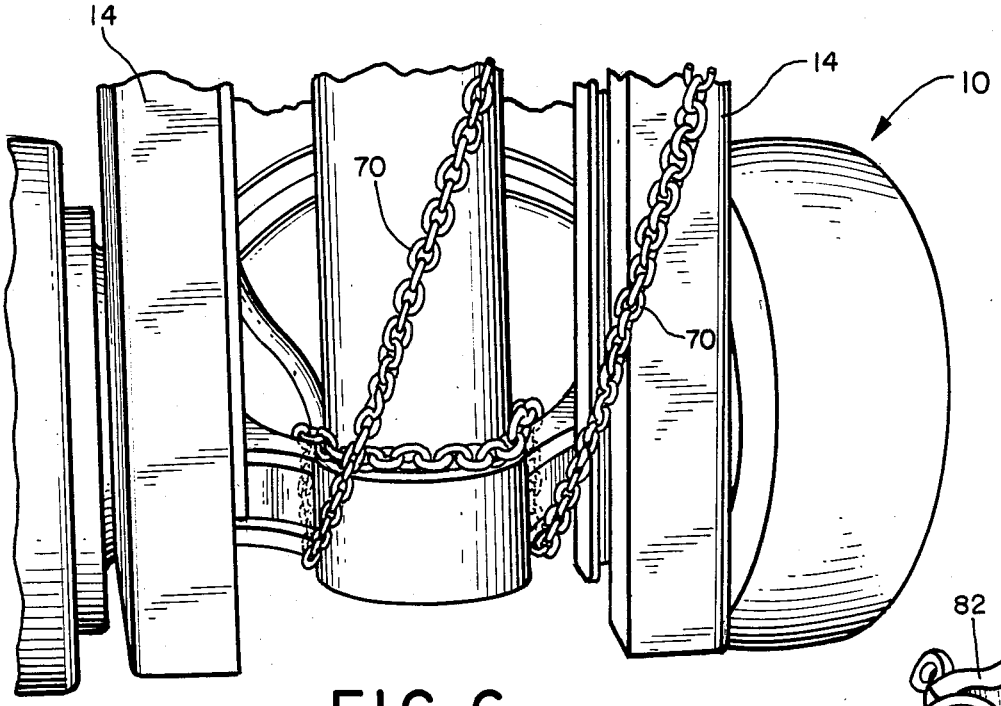
FIG. 6
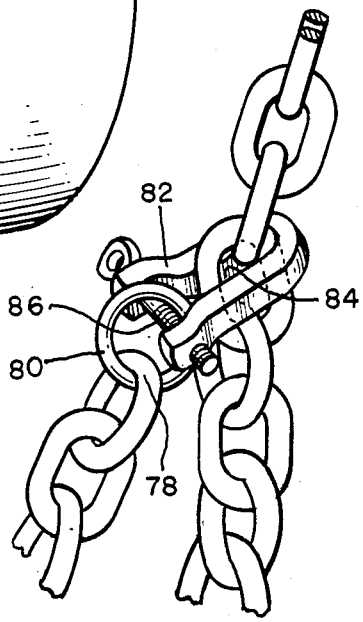
FIG. 7

CRANE FOR LIFTING DEVICE SUCH AS FORK LIFT

This application is a continuation, of application Ser. No. 06/531,755, filed Sept. 12, 1983, now abandoned.

BACKGROUND OF THE INVENTION

The present invention relates to a crane suitable for use with lifting devices, such as fork lifts, that provides particularly simple high lift capabilities.

Lifting devices such as fork lifts are in wide use, and there have been a number of prior art attempts to provide crane attachments to such fork lifts in order to increase the flexibility of their use. For example, Kraft U.S. Pat. No. 3,788,492 and Glass U.S. Pat. No. 3,759,399 both disclose extendable booms which can be mounted to the forks of a fork lift. By elevating the forks of the fork lift, such booms can be raised as necessary to move loads attached to the boom vertically. Turner U.S. Pat. No. 2,433,584 and Ehrlich U.S. Pat. No. 3,207,347 disclose two additional booms suitable for attachment to a fork lift. The structures shown in the drawings of each of the four above-identified patents suffer from the disadvantage that a load attached to the boom cannot be moved by a vertical distance greater then that through which the forks can be moved. Thus, if the forks of the fork lift can only be elevated by 6 feet, for example, the illustrated devices in these patents will not allow a load to be raised more than 6 feet. This is for the simple reason that the Glass and Kraft patents disclose booms which simply provide a hook at the end and the Turner and Ehrlich patents disclose booms having lines of fixed length coupled to the boom.

In the past, when it was desired to provide a crane for a fork lift with a lifting height greater than that of the fork lift, it was conventional to supply winch mechanisms which operated to vary the effective length of the cable included in the crane. Person U.S. Pat. No. 3,294,262, Morris U.S. Pat. No. 3,773,200, and Flynn U.S. Pat. Nos. 2,494,651 and 2,445,614 are four examples of such prior art cranes which include winch mechanisms. Of course, when a winch mechanism is provided the lifting height capacity of the crane may be made substantially independent of the lifting height capacity of the fork lift. For example, the two Flynn patents disclose systems in which the crane boom is not caused to move vertically with the forks of the fork lift at all, and the entire lifting capacity of the crane is provided by pivoting the crane boom and varying the effective length of the crane cable.

The use of such winch arrangements brings with it significant disadvantages in terms of the increased cost and complexity of the crane due to the addition of the winch assembly.

SUMMARY OF THE INVENTION

The present invention is directed to an improved crane for a lifting device such as a fork lift which does not require the use of winch assemblies as described above, yet which provides a lifting height capacity greater than that of the lifting device to which the crane is attached.

According to this invention, a crane is provided for a lifting device of the type which comprises an upright mast, a load support surface mounted to travel along the mast, and means for lifting the load support surface along the mast. The crane of this invention comprises a crane boom which is mounted to move with the load support surface. This crane boom defines a cable guide, and a cable is provided which passes over the cable guide and defines a first fixed section which is fixedly secured to the lifting device to remain substantially stationary with respect to the mast, and a second free section. A third section is interposed between the first and second sections of the cable and is positioned to contact the cable guide. Securing means, such as a hook, are secured to the second section of the cable, and the boom, guide and cable cooperate to cause the separation between the securing means and the guide to decrease as the boom is lifted by the load support surface and to increase as the boom is lowered by the load support surface such that vertical movement of the load support surface through a first distance causes a vertical movement of the securing means through a second distance which is greater than the first distance. The present invention provides a crane with a lifting height capacity greater than that of the lifting device to which it is attached, while utilizing a cable having an effective length which is substantially constant in use. The cost and complexity of winch mechanisms is thereby entirely avoided.

As will be seen from the detailed description which follows, preferred embodiments of this invention are particularly simple and direct in construction. They can readily be mounted to and removed from a fork lift in a simple and quick manner, and they provide important advantages in terms of increased lifting height capacity without motors or winches of any kind.

The invention itself, together with further objects and attendant advantages, will best be understood by reference to the following detailed description, taken in conjunction with the accompanying drawings.

BRIEF DESCRIPTION OF THE DRAWINGS

FIG. 1 is a side elevational view of a preferred embodiment of the lifting device of this invention mounted to a fork lift, in which the forks of the fork lift are in a raised position.

FIG. 2 is a side elevational view of the embodiment of FIG. 1 in which the forks of the fork lift are in a lowered position.

FIG. 3 is a front perspective view of the embodiment of FIG. 1.

FIG. 4 is a cross-sectional view taken along line 4—4 of FIG. 3.,

FIG. 5*a* is a fragmentary side elevational view of a lower portion of the embodiment of FIG. 1.

FIG. 5*b* is a fragmentary side elevational view of an upper portion of the embodiment of FIG. 1.

FIG. 6 is a perspective view showing the manner in which the cable of the embodiment of FIG. 1 is secured to the fork lift.

FIG. 7 is a fragmentary view showing the manner in which the fixed end of the cable is secured to the chain in the embodiment of FIG. 1.

DETAILED DESCRIPTION OF THE PRESENTLY PREFERRED EMBODIMENT

Turning now to the drawings, FIGS. 1 through 7 show various representations of a lifting device which incorporates a presently preferred embodiment of this invention. As best seen in FIGS. 1 through 3, the crane 20 of this invention is removably mounted to a lifting device such as a fork lift 10. In this embodiment, the fork lift 10 is of any conventional type, and includes an upright mast 14 as well as a load support surface such as a pair of forks 12. The forks 12 are mounted to the mast 14 so as to move vertically along the mast 14, and the fork lift 10 includes means (not shown) for moving the forks 12 along the mast 14. The fork lift 10 has been shown merely to clarify the working environment of the crane 20 and the fork lift 10 per se forms no part of the present invention. For this reason, the fork lift 10 will not be described in any greater detail here.

The crane 20 shown in the drawings comprises a base 30, a boom 50, and a cable 70. As best shown in FIGS. 3 and 4, the base 30 includes two spaced parallel channels 32. These two channels 32 are secured together at the underside by a cross-piece 34 and at the upper side by a base plate 38. A pair of spacers 36 are provided at the outer end of the channels 32. These spacers 36 cooperate with the cross-piece 34 such that the base 30 rests in a level configuration when placed on a level surface such as the ground. The base 30 also includes a boom brace 40 which extends upwardly from the outer ends of the channels 32. An eye 42 is defined at the upper intersection of the boom brace 40. This eye 42 can be used to hang a hook 74 in a storage position.

A chain 44 is provided which extends around the forks 12 and a portion of the base plate 38 to securely hold the base 30 in position on the forks 12 and to prevent the forks 12 from sliding out of the channels 32. As shown in FIGS. 3 and 4, the channels 32 are sized to receive the forks 12 and to capture the base 30 securely in place with respect to the forks 12. Thus, the channels 32 cooperate with the chain 44 to mount the base 30 securely in place on the forks 12.

The boom 50 is formed as a tapered channel which defines a lower end 52 and an upper end 54. The lower end 52 of the boom 50 is rigidly secured to the base plate 38 by means of a plurality of fasteners 56, as shown in FIG. 5*a*. As shown in FIGS. 1 through 3, the boom 50 extends obliquely and upwardly with respect to the base 30. The upper end 54 of the boom 50 serves to mount two parallel plates 58. These parallel plates 58 serve to locate an axle 62 which supports a cable guide such as a pulley 60. The pulley 60, which is best shown in FIG. 5*b*, is thus free to rotate about the axle 62 with respect to the upper end 54 of the boom 50.

A cable 70 passes over the pulley 60 as shown in FIG. 5*b*, and this cable 70 defines a free end 72 to which is secured a lifting hook 74. The cable 70 also defines a middle section 76 which runs over the pulley 60 as well as a fixed end 78.

As shown in FIG. 6, a portion of the cable 70 near the fixed end 76 is wrapped around the lower portion of the mast 14 so as fixedly to secure the cable 70 with respect to the mast 14 and therefore with respect to the fork lift 10. The fixed end 78 of the cable 70 is secured to a ring 80 as shown in FIG. 7. This ring 80 is in turn secured to a slotted clevis 82. This slotted clevis 82 is a generally U-shaped link which defines a slot 84. The slot 84 is closed by a threaded pin 86 which extends across the two arms of the U-shaped clevis 82. The pin 86 is used to secure the clevis 82 to the ring 80, and thereby to the cable 70. The slot 84 defined by the clevis 82 is large enough to receive a single link of the cable 70, as shown in FIG. 7. However, the slot 84 is too narrow to allow the clevis 82 to slip or move along the length of the cable 70. Thus, the clevis 82 provides a simple and convenient arrangement for adjusting the effective length of the cable 70.

As used herein, the term "cable" is meant in its broad sense, and is intended to cover all types of cables, including chains, ropes, wire ropes, and the like.

As shown in FIGS. 3 through 5*a*, an air horn 90 is secured to the base plate 38 adjacent the lower end 52 of the boom 50 by means of a bracket 96. A pivot arm 92 is pivotably mounted to the boom 50 to rotate about a pivot axis 96. One end of this pivot arm 92 is positioned to contact an actuator button 91 included on the air horn 90, and the other end of the pivot arm 92 is coupled via a release spring 98 to an actuator cable 100. This actuator cable 100 extends along the underside of the boom 50, guided by a plurality of guides 102. The upper end of the actuator cable 100 is secured to an actuator 104 which is mounted to the upper end 54 of the boom 50 to pivot about a pivot axis 106. As shown in FIG. 3, the actuator 104 is shaped as a loop which encloses the cable 70. As shown in FIG. 5*b*, the actuator 104 is pivoted in a counterclockwise position in the view of FIG. 5*b* (from the position shown in solid lines to the position shown in dotted lines) when the free end 72 of the cable 70 approaches too closely to the pulley 60. When the actuator 104 is moved upwardly, this motion of the actuator 104 is transmitted via the actuator cable 100 to the pivot arm 92, thereby causing the pivot arm 92 to rotate in a counterclockwise direction in the view of FIG. 5*a* so as to depress the actuator button 91 and sound the air horn 90. In this way, an alarm is provided which warns an operator if the fork lift 10 is operated so as to bring the free end 72 of the cable 70 excessively close to the pulley 60.

Any of a variety of commercially available devices can be used for the air horn 90. For example, air horns of the type typically used in recreational boat signaling may be suitable.

The crane 20 of this preferred embodiment is formed of steel components which are welded and bolted together to form a rigid unit. Of course, it should be understood that materials, dimensions and design details should be choosen as appropriate using well known engineering techniques to provide the crane 20 with the desired weight lifting capacity.

In order to understand the operation of the crane 20 it is important to recognize that the cable 70 is provided with an effective length which is substantially constant. This is because the cable 70 is fixedly secured to a lower portion of the mast 14 and the length of the cable 70 between the point at which it is fixed to the mast 14 and the free end 72 is substantially constant in use. Of course, the cable 70 may stretch or elongate somewhat when the crane 20 is used to lift heavy objects. Nevertheless, the effective length of the cable 70 remains substantially constant because no winch mechanism or the like is used to reel the cable 70 in and out during use of the crane 20.

In spite of the fact that no winch apparatus is provided, the crane 20 can be used to lift a load such as a weight 108 through a vertical distance which is greater than the vertical distance through which the forks 12 can be lifted. This feature of the crane 20 is best shown by FIGS. 1 and 2. In FIG. 2, the crane 20 is in a lower position, as is the weight 108. Note that the distance between the free end 72 and the pulley 60 is approximately equal to the effective height of the boom 50 above the base 30. Furthermore, the forks 12 and the weight 108 are situated at the same vertical level.

When the fork lift 10 is used to raise the forks 12 to an upper position as shown in FIG. 1, the free end 72 of the cable 70 comes much closer to the pulley 60. This is due to the fact that the cable 70 is afixed to the lower end of the mast 14, and not to the base 30. For this reason, the free end 72 of the cable 70 and therefore the weight 108 are raised through a greater vertical distance than is the base 30 of the crane 20. Note in FIG. 1 that the weight 108 is situated substantially above the level of the base 30. Thus, the crane 20 can be used to raise a load such as the weight 108 through a greater vertical distance than the height lifting capacity of the fork lift 10. This important advantage is provided without the cost or complexity of winch mechanisms or the like.

From the foregoing, it should be apparent that an improved crane has been disclosed which is simple and reliable in construction and which provides important advantages in terms of increased height lifting capacity without the need for winch mechanisms or the like. Of course, it should be understood that a wide range of changes and modifications can be made to the preferred embodiment described above. Details of construction, materials, proportions and dimensions can all be varied as needed to suit individual applications. It is therefore intended that the foregoing detailed description be regarded as illustrative rather than limiting, and that it be understood that it is the following claims, including all equivalents, which are intended to define the scope of the invention.

We claim:

1. In a fork lift of the type comprising an upright mast, a set of forks mounted to travel along the mast, and means for moving the forks along the mast in order to raise and lower the forks, the improvement comprising:

a crane base comprising two closed section channels interconnected at one end by a base plate arranged to orient the channels parallel to one another, each of said channels defining a respective brace section at the end of the channel opposite the base plate;

a tapered crane boom having a lower end rigidly mounted to the base plate to extend upwardly from the crane base at an oblique angle with respect to the crane base, said boom defining an upper end disposed above the crane base, said upper end positioned above the lower end by at least twice the length of the closed section channels;

a pair of reinforcing braces mounted to extend diagonally between an intermediate portion of the crane boom and respective ones of the brace sections of the channels;

a pulley mounted to rotate at the upper end of the crane boom;

a cable having a fixed end wrapped around a lower portion of the mast, said cable extending from the lower portion of the mast, over the pulley, and defining a free end on the opposite side of the pulley from the fixed end, said cable extending below the crane boom between the lower portion of the mast and the pulley such that the cable is accessible from below the crane boom;

means for adjustably securing the fixed end to the cable to secure the cable around the lower portion of the mast and to adjust the effective length of the cable;

means, attached to the free end of the cable, for securing the cable to a load; and a support positioned under the channels to support the channels on a support surface such that the forks can be inserted in the channels with the forks raised above the support surface;

said base, boom, pulley and cable cooperating to raise the securing means when the base is raised by the forks such that the separation between the securing means and the pulley is automatically and progressively decreased when the base is raised on the mast, and the separation between the securing means is automatically and progressively increased when the base is lowered on the mast, while the effective length of the cable between the fixed end and the free end remains substantially constant.

2. The invention of claim 1 further comprising: means for sounding an alarm when the separation betwen the load securing means and the pulley falls below a predetermined value.

3. The invention of claim 1 wherein the cable comprises a chain.

4. The invention of claim 1 wherein the cable comprises a chain and wherein the adjustably securing means comprises a slotted clevis sized to fit over the chain but not to slip along the chain.

* * * * *